US006837571B2

(12) United States Patent
Hara

(10) Patent No.: US 6,837,571 B2
(45) Date of Patent: Jan. 4, 2005

(54) COLOR INK-JET PRINTER

(75) Inventor: Koichiro Hara, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/696,437

(22) Filed: Oct. 29, 2003

(65) Prior Publication Data

US 2004/0085375 A1 May 6, 2004

(30) Foreign Application Priority Data

Oct. 30, 2002 (JP) ..... 2002-315201

(51) Int. Cl.[7] ..... B41J 2/21; B41J 2/205
(52) U.S. Cl. ..... 347/43; 347/15
(58) Field of Search ..... 347/43, 15, 9, 347/12, 100, 10, 11, 14, 19

(56) References Cited

U.S. PATENT DOCUMENTS 5,801,838 A * 9/1998 Larson ..... 358/3.1
6,024,438 A * 2/2000 Koike et al. ..... 347/43
6,416,149 B2 7/2002 Takahashi
6,682,170 B2 * 1/2004 Hotomi et al. ..... 347/43
6,702,416 B2 * 3/2004 Vanhooydonck ..... 347/15

* cited by examiner

*Primary Examiner*—Thinh Nguyen
(74) *Attorney, Agent, or Firm*—Reed Smith LLP

(57) ABSTRACT

A color ink-jet printer including a first ink ejecting portion operable to eject droplets of a first ink of a first color, a second ink ejecting portion operable to eject droplets of a second ink of a second color other than the first color, which second ink is dried at a higher rate than said first ink, a first control portion operable to control the first ink ejecting portion, on the basis of a gray-scale value at a picture element corresponding to each dot of the first ink to be formed on a recording medium, such that a total volume of at least one droplet of the first ink ejected by the first ink ejecting portion to form each dot of the first ink is equal to any one of a plurality of different total volume values, and a second control portion operable to control the second ink ejecting portion, on the basis of a gray-scale value at a picture element corresponding to each dot of the second ink to be formed on the recording medium, such that a total volume of at least one droplet of the second ink ejected by the second ink ejecting portion to form each dot of the second ink is equal to one of the different total volume values, which is other than a smallest one of the different total volume values except a zero value which does not cause ejection of any ink droplet from the second ink ejecting portion.

14 Claims, 8 Drawing Sheets

RELATED ART

COLOR INK-JET PRINTER

The present application is based on Japanese Patent Application No. 2002-315201 filed Oct. 30, 2002, the contents of which are incorporated herein by reference.

BACKGROUND OF THE INVENTION

1. Field of the Invention

The present invention relates to a color ink-jet printer capable of ejecting ink droplets of different colors.

2. Discussion of Related Art

U.S. Pat. No. 6,416,149 B2 (in particular, FIGS. 4–6, and col. 1, lines 46–53 and col. 5, lines 43–50) corresponding to JP-2001-301206A discloses an ink-jet printer operable such that at least one droplet of an ink each having a predetermined volume is ejected from each nozzle, so as to form a dot of ink on a recording medium in the form of a paper sheet, such that where a plurality of ink droplets are ejected from the nozzle, the ink droplets overlap each other so as to form one ink dot. Thus, a desired gray-scale value can be established at each picture element of an image corresponding to each ink dot to be formed on the paper sheet according to image data (printing data), by suitably selecting one of three different total volume values (large, medium and small values) of the above-indicated at least one ink droplet, for each of the ink dots, so that each ink dot has the corresponding one of three different sizes or diameters which are determined by the respective three different total volume values.

If the technique disclosed in the above-identified U.S. Patent is applied to a color ink-jet printer having a plurality of rows of nozzles that are arranged to eject droplets of inks of respective different colors (e.g., yellow [Y], magenta [M], cyan [C] and black [B]), the same number of the ink droplets corresponding to one ink dot are ejected for each of the different colors, that is, the total volume of the ink droplets corresponding to one ink dot is the same for all of the different colors, when the gray-scale values at picture elements corresponding to the four colors are equal to each other. However, the inks of different colors have different compositions including different coloring agents and having different drying speeds, and the viscosity of the ink having a relatively high drying speed may be excessively increased at the meniscus surface of the ink remaining in a given nozzle, due to evaporation of an aqueous component of the ink at the meniscus surface, which takes place if the ejection of the ink droplets from that nozzle is absent for a relatively long time. In this case, the nozzle may suffer from so-called "plugging" due to increased viscosity of the ink at the meniscus surface, particularly when the ink droplets ejected last from that nozzle to form the last ink dot have a relatively small volume. This plugging may lead to a failure to subsequently eject at least the first one of the droplets to be ejected from the plugged nozzle to form the next ink dot. In this instance, the ink dot is not formed at a predetermined point on the paper sheet, resulting deterioration of quality of an image printed on the paper sheet.

The aspect indicated above will be described in detail by reference to FIG. 8, which shows an example of an arrangement of ink dots of four colors (Y, M, C and K) to be formed on a paper sheet according to print data, where the yellow ink has the highest drying speed. In this example, all picture elements corresponding to the respective ink dots have the same gray-scale value according to the print data, which value corresponds to only one ink droplet of a relatively small volume to be ejected from the nozzle. Further, the operations to eject the ink dots at the respective picture elements are commanded a short time after the moment of initiation of a printing operation after a relatively long non-ink-ejection period. Solid-line circles in FIG. 8 indicate the magenta, cyan and black ink dots which have been actually formed on the paper sheet, while broken-line circles in FIG. 8 indicate the yellow ink dots which have not been actually formed on the paper sheet, due to a failure of ejection of the yellow ink droplets from the respective nozzles of the ink-jet head corresponding to the yellow ink. Namely, these nozzles corresponding to the yellow ink were plugged with the dried yellow ink during the relatively long non-ink-ejection period, so that the yellow ink droplets of the relative small volume can not be subsequently ejected from the plugged nozzles. In this case, a local area corresponding to the picture elements for the yellow ink dots remains blank on the paper sheet, resulting in deterioration of quality of the image printed on the paper sheet.

SUMMARY OF THE INVENTION

It is therefore an object of the present invention to provide a color ink-jet printer which is capable of forming a gray-scale image by selecting one of a plurality of different total volume values of at least one ink droplet to be ejected from each nozzle to form the corresponding ink dot at the corresponding picture element on a recording medium, and which is arranged to minimize deterioration of quality of the printed image due to plugging of the nozzle with a dried ink.

The object indicated above may be achieved according to a first aspect of this invention, which provides a color ink-jet printer comprising: a first ink ejecting portion operable to eject droplets of a first ink of a first color; a second ink ejecting portion operable to eject droplets of a second ink of a second color other than the first color, the second ink being dried at a higher rate than the first ink; a first control portion operable to control the first ink ejecting portion, on the basis of a gray-scale value at a picture element of an image at which each dot of the first ink is to be formed on a recording medium, such that a total volume of at least one droplet of the first ink ejected by the first ink ejecting portion to form each dot of the first ink on the recording medium is equal to any one of a plurality of different total volume values; and a second control portion operable to control the second ink ejecting portion, on the basis of a gray-scale value at a picture element of the image at which each dot of the second ink is to be formed on the recording medium, such that a total volume of at least one droplet of the second ink ejected by the second ink ejecting portion to form each dot of the second ink on the recording medium is equal to one of the plurality of different total volume values, which one is other than a smallest value of the different total volume values except a zero value which does not cause ejection of any ink droplet from the second ink ejecting portion.

In the color ink-jet printer constructed according to the first aspect of the present invention as described above, the total volume of at least one droplet of the second ink ejected by the second ink ejecting portion to form each dot of the second ink is made equal to one of the different total volume values, which is other than the smallest value of the different total volume values except the zero value which does not cause ejection of any droplet of the second ink from the second ink ejecting portion. That is, when the gray-scale value at the picture element at which a dot of the second ink is to be formed corresponds to the smallest total volume value, the selection of this smallest total volume value to form the smallest dot of the second ink is inhibited, and any suitable one of the larger total volume values is selected, so that the nozzles of the second ink ejecting portion are less likely to be subsequently plugged with the second ink dried at the meniscus surface, due to absence of ejection of droplets of the second ink from those nozzles for a relatively long time, which would cause an increase in the viscosity of the ink within the nozzles. Accordingly, the present arrangement permits formation of a gray-scale image by selecting one of the different total volume values of at least one droplet of the second ink, other than the smallest value except the zero value, substantially according to the gray-scale values at the individual picture elements of the image.

In a first preferred form of the first aspect of the present invention, the color ink-jet printer further comprises first and second pulse generators operable to generate drive pulse signals to be applied to the first and second ink ejecting portions, respectively, such that the total volume of the above-indicated at least one droplet forming each dot of the first ink and the total volume of the above-indicated at least one droplet forming each dot of the second ink are variable with a change in the number of the above-indicated at least one droplet to be ejected from each of the first and second ink ejecting portions to form each ink dot on the recording medium.

In one advantageous arrangement of the first preferred form of the invention described above, the total volume of the at least one droplet forming each dot of the first ink and the total volume of the at least one droplet forming each dot of the second ink are variable while the volume of each of the above-indicated at least one droplet is kept constant. However, this arrangement is not essential. Further, the volume of each droplet of an ink dot corresponding to a given gray-scale value at the corresponding picture element may be different from the volume of each droplet of an ink dot corresponding to another gray-scale value at the corresponding picture element.

The color ink-jet printer may further comprise a pulse generator operable to generate drive pulse signals to be applied to the second ink ejecting portion such that the above-indicated smallest one of the plurality of the different total volume values is provided by only one droplet of the second ink, while each of the other of the different total volume values is provided by at least two droplets of the second ink. Where the smallest total volume were selected to eject only one droplet of the second ink from a given nozzle, this ink droplet would not be actually ejected from the nozzle due to an increased viscosity value of the ink at its meniscus surface during a relatively long non-ejection period of the second ink from that nozzle. In the present color ink-jet printer, however, the second control portion is operable to inhibit the selection of the smallest total volume value, that is, inhibit an operation of the second ink ejecting portion to eject only one very small droplet and command an operation of the second ink ejecting portion to eject one droplet larger than the very small droplet or to eject at least two droplets. One droplet larger than the very small droplet has a larger kinetic energy than the very small droplet and can be ejected from the nozzle. In the case of ejection of at least two droplets, even if the first one of these at least two droplets may not be ejected from the nozzle, the second droplet (and the following droplet or droplets, if any) can be ejected to form a dot of the second ink on the recording medium.

In a second preferred form of the first aspect of the invention, the color ink-jet printer further comprises first and second pulse generators operable to generate drive pulse signals to be applied to the first and second ink ejecting portions such that the total volume of the above-indicated at least one droplet forming each dot of the first ink and the total volume of the above-indicated at least one droplet forming each dot of the second ink are changed by changing the volume of at least one of the above-indicated at least one droplet to be ejected from each of the first and second ink ejecting portions. In this case, the first and second pulse generators may be arranged to generate the drive pulse signals such that each dot of each of the first and second inks is provided by only one ink droplet, and such that the volume of this one ink droplet is changed to change a size of each dot on the basis of the gray-scale value at the corresponding picture element of the image. In this instance, the selection of the smallest dot of the second ink having the smallest volume is inhibited by the second control portion, that is, the comparatively large dot of the second ink is selected so that this second ink dot can be formed on the recording medium, by the single droplet of the second ink having the comparatively large volume, which can be ejected from the nozzle even if the ink the nozzle has been more or less dried.

In a third preferred form of the color ink-jet printer of the first aspect of the invention, the second control portion is operable to select the above-indicated one of the plurality of different total volume values, within a predetermined length of time after a moment of initiation of an operation of the second ink ejecting portion to eject the above-indicated at least one droplet of the second ink, which operation is initiated after expiration of a predetermined non-ink-ejection period during which the second ink ejecting portion is kept in a non-operated state, the second control portion selecting any one of the plurality of different total volume values on the basis of the gray-scale value at the picture element corresponding to each dot of the second ink, after expiration of said predetermined length of time.

In the color ink-jet printer constructed according to the third preferred form of the first aspect of the invention described above, another value of the different total volume values other than the smallest value except the zero value is selected as the total volume of at least one droplet of the second ink from the second ink ejecting portion, only within the predetermined length of time after the moment of initiation of an operation of the second ink ejecting portion which is initiated after expiration of the predetermined non-ink-ejection period. Accordingly, this arrangement is effective to minimize the deterioration of quality of the image due to plugging of the nozzles with the dried ink, within the above-indicated predetermined length of time. After the expiration of this predetermined length of time after the initiation of the operation of the second ink ejecting portion, the viscosity of the ink at the meniscus surface of the ink at the nozzles is lowered to a value close to the normal value, so that substantially no plugging of the nozzles would take place after the predetermined length of time, therefore, the second control portion selects any one of the plurality of different volume values which include the smallest value, so that the gray-scale image can be formed with improved quality owing to the availability of all of the plurality of different total volume values according to the gray-scale values at the individual picture elements.

In a fourth preferred form of the first aspect of the invention, the color ink-jet printer further comprises a pulse generator operable to generate drive pulse signal to be applied to the second ink ejecting portion such that the plurality of different total volume values comprise at least three different total volume values including the zero value, the smallest value, and at least one value larger than the smallest value, and wherein when the gray-scale value at the picture element corresponds to the smallest value, the second control portion selects one of the above-indicated at least one value larger than the smallest value.

In one advantageous arrangement of the fourth preferred form of the invention described above, the smallest value corresponds to a very small dot of the second ink, and the at least one value larger than the smallest value includes at least two values including two values which respectively correspond to a small dot of the second ink and a dot of the second ink larger than said small dot, and wherein the above-indicated one of the at least one value larger than the smallest value is one of the two values which corresponds to the small dot.

The first and second colors may be selected as desired, for example, from among black, yellow, magenta and cyan.

In a fifth preferred form of the first aspect of the invention, the color ink-jet printer further comprises a pulse-waveform-data memory for storing pulse-waveform data indicative of a plurality of different waveforms of drive pulse signals to be applied to the first and second ink ejecting portions, the plurality of different waveforms corresponding to the plurality of different total volume values, respectively, and wherein the first control portion is operable to select one of the plurality of different waveforms that corresponds to the above-indicated any one of the plurality of different total volume values, and the second control portion is operable to select one of the plurality of different waveforms that corresponds to the above-indicated one of the plurality of different total volume values.

The object indicated above may also be achieved according to a second aspect of this invention, which provides, a color ink-jet printer comprising: a first ink ejecting portion operable to eject droplets of a first ink of a first color; a second ink ejecting portion operable to eject droplets of a second ink of a second color other than the first color, the second ink being dried at a higher rate than the first ink; a pulse-waveform-data memory for storing pulse-waveform data indicative of a plurality of different waveforms corresponding to respective different total volume values of at least one droplet of each of the first ink and the second ink; a first control portion operable to select any one of the plurality of different waveforms stored in the pulse-waveform-data memory, on the basis of a gray-scale value at a picture element of an image at which each dot of the first ink is to be formed on a recording medium, and control the first ink ejecting portion to eject the at least one droplet of the first ink, on the basis of the selected any one of the plurality of different waveforms; and a second control portion operable to select, on the basis of a gray-scale value at a picture element of the image at which each dot of the second ink is to be formed on the recording medium, one of the plurality of different waveforms which corresponds to one of the plurality of different total volume values, the one of the plurality of different total volume values being other than a smallest one of the different total volume values except a zero value which does not cause ejection of any ink droplet from the second ink ejecting portion, and control the second ink ejecting portion to eject the at least one droplet of the second ink, on the basis of the selected one of the plurality of different waveforms.

In a first preferred form of the above-described second aspect of the invention, the color ink-jet printer further comprises a first pulse generator operable to generate a drive pulse signal to be applied to the first ink ejecting portion, on the basis of the above-indicated any one of the plurality of different waveforms selected by the first control portion, and a second pulse generator operable to generate a drive pulse signal to be applied to the second ink ejecting portion, on the basis of the above-indicated one of the plurality of different waveforms selected by the second control portion.

In a second preferred form of the color ink-jet printer of the second aspect of the invention, the plurality of different waveforms stored in the pulse-waveform-data memory correspond to the respective different total volume values which comprise at least two different total volume values including the smallest value and at least one value larger than the smallest value, the second control portion being operable to select one of the at least one value larger than the smallest value when the gray-scale value at the picture element corresponds to the smallest value.

In a third preferred form of the second aspect of the invention, the color ink-jet printer further comprises a time counter operable to measure a non-ink-ejection time during which the second ink ejecting portion is kept in a non-operated state, and wherein the second control portion selects the above-indicated one of the plurality of different waveforms on the basis of the gray-scale value at the picture element corresponding to each dot of the second ink when an operation of the second ink ejecting portion is initiated after the non-ink-ejection time measured by the time counter has become longer than a predetermined non-ink-ejection period, the time counter being further operable to measure a predetermined length of time after a moment of initiation of the operation of the second ink ejecting portion to eject the at least one droplet of the second ink, the second control portion selecting any one of the plurality of different waveforms on the basis of the gray-scale value at the picture element corresponding to each dot of the second ink after the predetermined length of time has been measured by the time counter.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENTS

Figure 1:
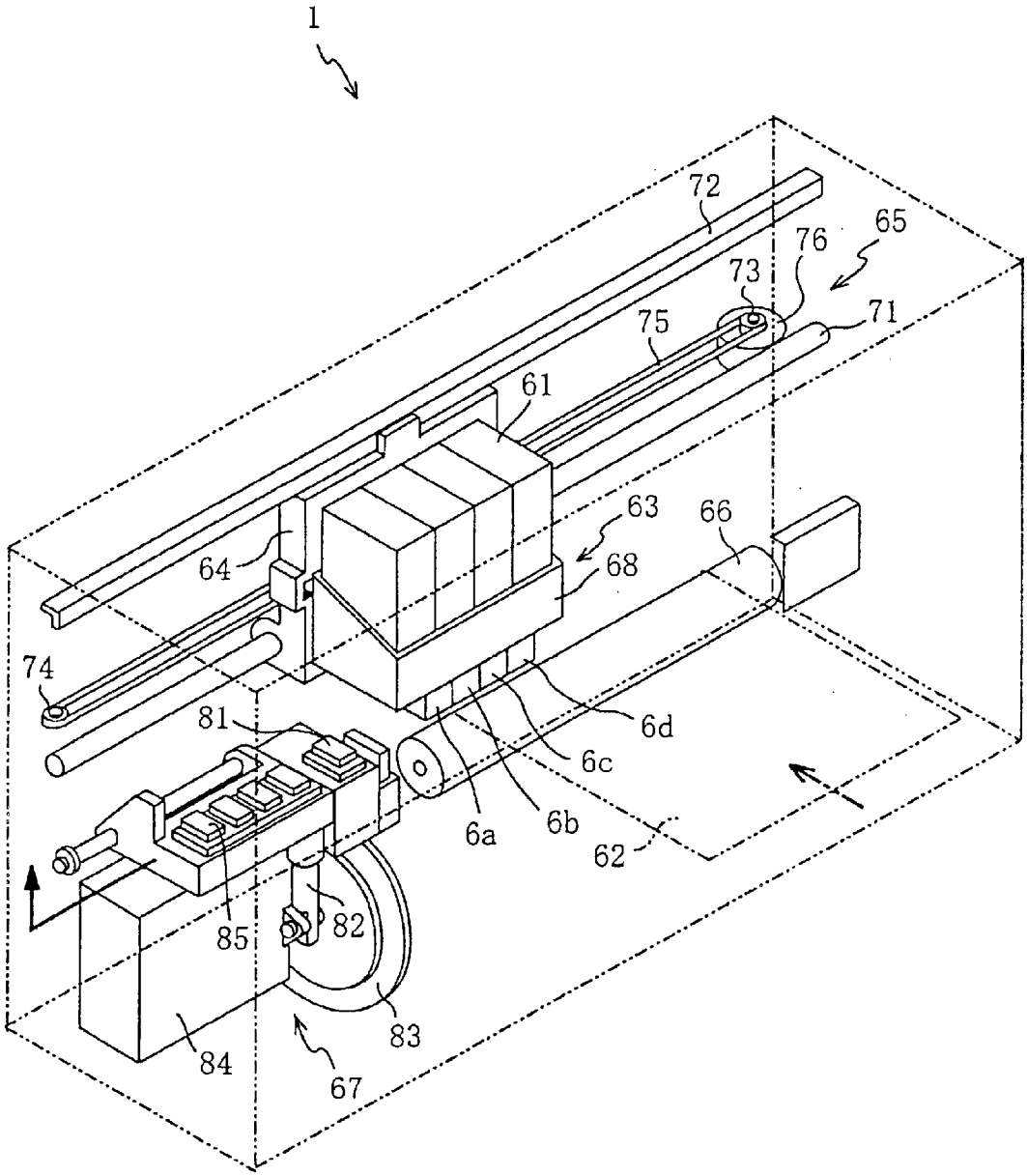
FIG. 1 is a perspective view schematically showing an internal arrangement of a color ink-jet printer constructed according to a first embodiment of this invention.

Referring to the drawings, preferred embodiments of the present invention will be described.

Reference is first made to the schematic perspective view of FIG. 1 showing the internal arrangement of a color ink-jet printer constructed according to a first embodiment of this invention. As shown in FIG. 1, the color ink-jet printer indicated at 1 incorporates a head unit 63 having a frame 68 on which there are fixed four piezoelectric ink-jet heads 6*a*, 6*b*, 6*c* and 6*d* arranged to eject droplets of inks of respective four colors, namely, yellow (Y), magenta (M), cyan (C) and black (K). On the frame 68, there are also removably fixed four ink cartridges 61 which are filled with the inks of respective four colors and which are arranged to supply the inks to the respective ink-jet heads 6*a*–6*d*. The frame 68 is attached to a carriage 64 which is reciprocated along a straight line by a drive mechanism 65. The present color ink-jet printer 1 is further provided with a platen roller 66, which is disposed such that its axis of rotation is parallel to a direction of reciprocation of the carriage 64. The platen roller 66 is rotated by a drive device (not shown) to feed a recording medium in the form of a sheet of paper 62 in a feeding direction perpendicular to the direction of reciprocation of the carriage 64. The four ink-jet heads 6*a*–6*b* are arranged in the direction of reciprocation of the carriage 64, along a straight line which is parallel to the axis of rotation of the platen roller 66 and located adjacent to a circumferential surface of the platen roller 66.

The carriage 64 is supported by a guide shaft 71 and a guide plate 72 which are disposed so as to extend in the axial direction of the platen roller 66. The carriage 64 is slidable on these guide shaft and plates 71, 72 by the above-indicated drive mechanism 65, which includes a pair of pulleys 73, 74 rotatably disposed near the respective opposite ends of the guide shaft 71, and an endless belt 75 which connects the two pulleys 73, 74 and to which the carriage 64 is fixed.

The drive mechanism 65 further includes a drive motor 76 which is connected to the driving pulley 73 to rotate this pulley 73 in a selected one of opposite directions, for reciprocating the carriage 64 along the guide shaft and plate 71, 72, to thereby reciprocate the head unit 63 in the direction of reciprocation of the carriage 64.

The printer 1 is further provided with a sheet feeding mechanism (not shown) arranged to feed the paper sheet 62 from a sheet feeder cassette (not shown). The paper sheet 62 fed from the sheet feeder cassette is passed through a clearance or gap between an array of the ink-jet heads 6*a*–6*d* and the circumferential surface of the platen roller 66, when an image is printed on the paper sheet 62, with the droplets of inks ejected from the ink-jet heads 6*a*–6*d*. The paper sheet 62 with the printed image is ejected onto a paper tray (not shown) by a sheet ejecting mechanism (not shown).

Figure 2:
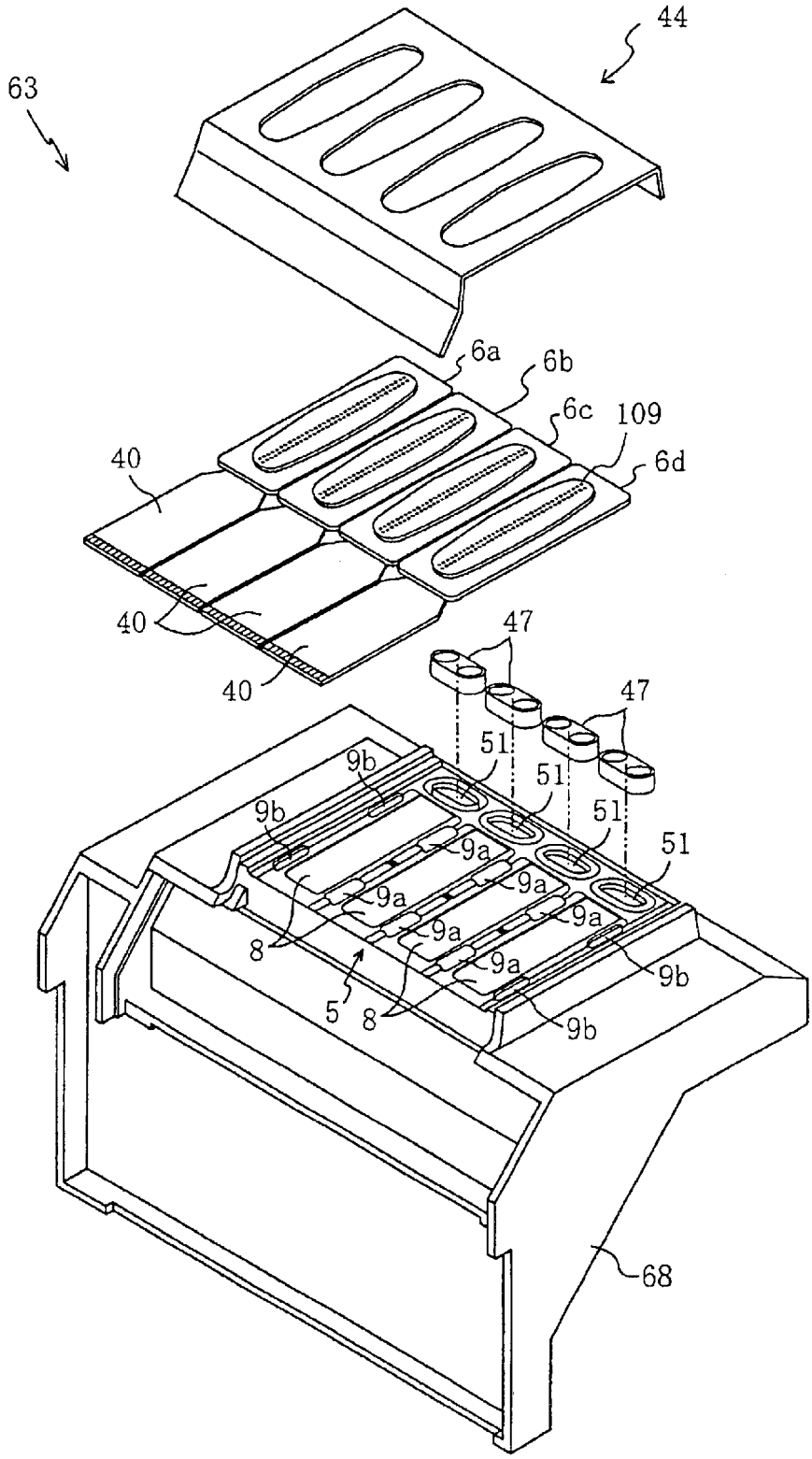
FIG. 2 is an exploded perspective view showing a head unit included in the color ink-jet printer of FIG. 1, when the head unit is vertically inverted.
Figure 3:
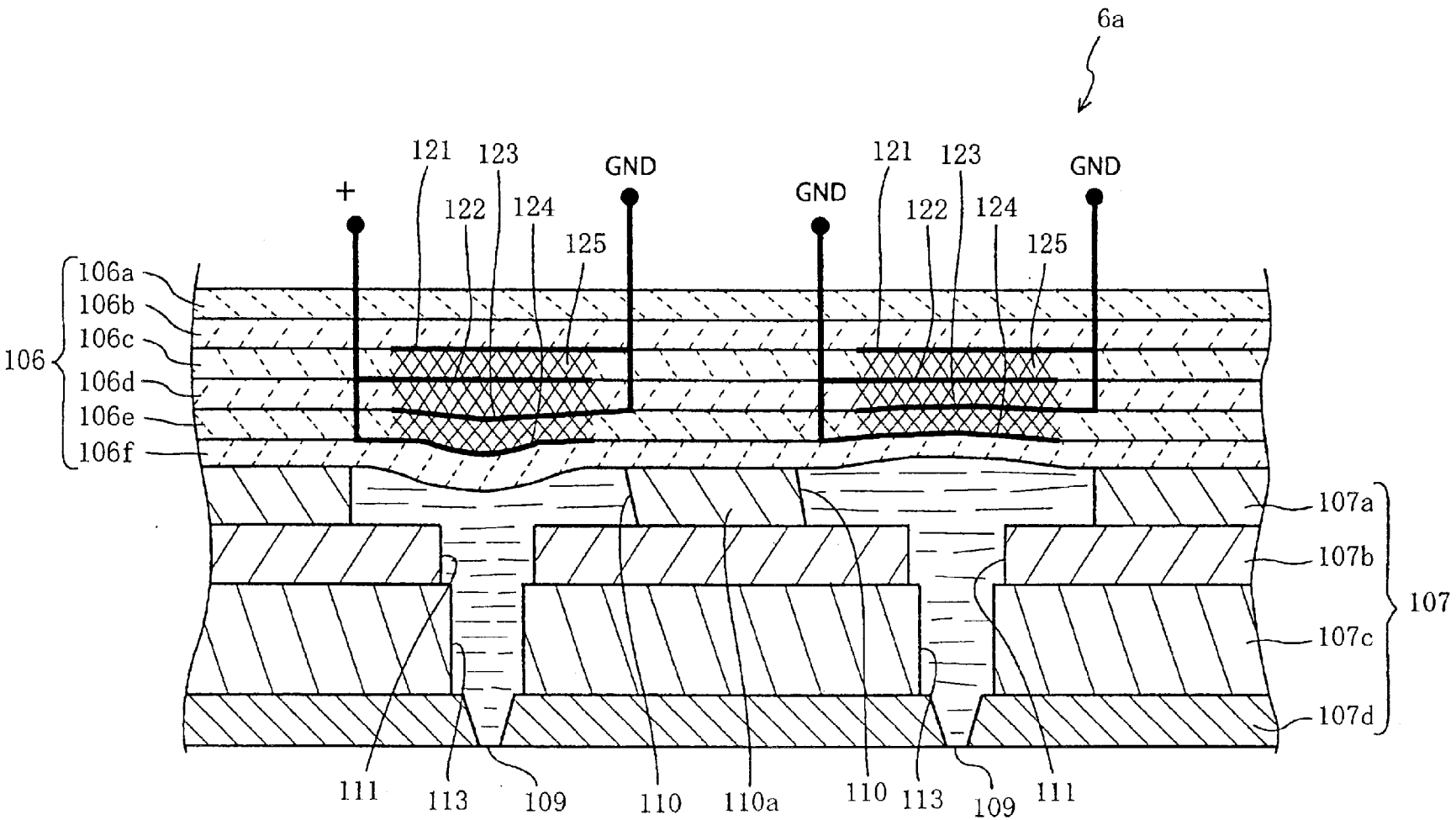
FIG. 3 is a fragmentary elevational view in cross section showing one of ink-jet heads of the head unit of FIG. 2.

The color ink-jet printer 1 is further provided with a purge mechanism 67 arranged to remove, by suction, poor-quality inks which remain in the ink-jet heads 6*a*–6*d* and which contain air bubbles and foreign matter. The purge mechanism 67 is located near one of the opposite axial ends of the platen roller 66 such that the purge mechanism 67 is spaced apart from the above-indicated one end of the platen roller 66 in the axial direction away from the other end, so that the four ink-jet heads 6*a*–6*b* are sequentially aligned with the purge mechanism 67, one after another, when the head unit 63 is returned to a predetermined home position by the drive mechanism 65. The purge mechanism 67 has a purge cap 81 which is arranged to cover a multiplicity of nozzles 109 which are open in the lower surface of each ink-jet head 6*a*, 6*b*, 6*c*, 6*d*, as shown in FIGS. 2 and 3. That is, the purge cap 81 is arranged to contact with an area of the lower surface of each head in which the nozzles 109 are open.

As shown in FIG. 1, the purge mechanism 67 includes a pump 82 which is driven by a cam 83, when the head unit 63 is located at a position near its home position and the nozzles 109 of a selected one of the ink-jet heads 6*a*–6*d* are covered by the purge cap 81. The poor-quality inks removed from the ink-jet heads 6*a*–6*d* by the purge mechanism 67 are discarded into a waste ink reservoir 84. Thus, the purge mechanism 67 functions to sequentially restore the four ink-jet heads 6*a*–6*d* to their normal state, by removing the air bubbles from the inks within the ink-jet heads upon initial filling of the inks, for thereby preventing failures of the ink-jet heads to eject the ink droplets due to growth of the air bubbles during a printing operation of the head unit 63. As shown in FIG. 1, four caps 85 are disposed near the purge cap 81, so that the nozzles 109 of the four ink-jet heads 6*a*–6*d* are covered by the respective four caps 85 when the head unit 63 is located at its home position after a printing operation.

Referring next to the exploded perspective view of FIG. 2 showing the head unit 63 in its vertically inverted posture, the frame 68 has a generally rectangular box structure which is open upwards as seen in FIG. 1 (downwards as seen in FIG. 2), so that the four ink cartridges 61 can be removably accommodated in a cartridge installation space within the box structure.

The frame 68 has a bottom wall 5 having an upper surface which partially defines the above-indicated installation space for accommodating the ink cartridges 61, and a lower surface (upper surface as seen in FIG. 2) to which the ink-jet heads 6*a*–6*d* are attached. This bottom wall 5 has four ink supply holes 51 formed therethrough between the above-indicated upper and lower surfaces such that the ink supply holes 51 are held in communication with ink outlet portions of the ink cartridges 61 accommodated in place in the cartridge installation space of the box structure of the frame 68. To the lower surface of the bottom wall 5, there are attached four rubber joints 47 which are arranged to connect the respective ink supply holes 51 to ink inlet portions of the respective ink-jet heads 6*a*–6*d*.

As shown in FIG. 2, the bottom wall 5 has four head support portions 8 in the form of rectangular stepped recesses formed in its lower surface, so that the four ink-jet heads 6*a*–6*d* are partially received in the respective recesses, and fixed to the bottom wall 5 with a UV-curable adhesive agent which fills respective slots 9*a*, 9*b* formed through the thickness of the bottom wall 5, near the recesses. The ink-jet heads 6*a*–6*d* thus supported by the head support portions 8 are covered by a covering member 44, which has four elongate oval openings as shown in FIG. 2, so that the rows of the nozzles 109 of the ink-jet heads 6*a*–6*d* are exposed through the respective openings. As also shown in FIG. 2, the four ink-jet heads 6*a*–6*d* are provided with respective flexible printed-circuit (FPC) boards 40 fixed thereto for applying drive pulse signals to their actuator units 106 (FIG. 3). As described below by reference to FIGS. 5A–5D, each drive pulse signal selectively has a ground potential and a positive potential.

Referring further to the fragmentary cross sectional view of FIG. 3, there is shown the ink-jet head 6*a*, by way of example. The other three ink-jet heads 6*b*, 6*c* and 6*d* have the same construction as the ink-jet head 6*a*, which will be described in detail. It is noted, however, that the four ink-jet heads 6*a*, 6*b*, 6*c* and 6*d* are assigned to eject droplets of a yellow (Y) ink, a magenta (M) ink, a cyan (C) ink and a black (K) ink, respectively. In the present embodiment, it is assumed that the yellow ink (Y) is dried at a higher rate than the other inks (M, C, B). The nozzles 109 of each of the ink-jet heads 6*b*, 6*c* and 6*d* function as a first ink ejection portion, while the nozzles 109 of the ink-jet head 6*a* function as a second ink ejection portion.

As shown in FIG. 3, the ink-jet head 6*a* has an actuator unit 106 and a flow-passage unit 107 superposed on each other. The actuator unit 106 is driven or operated according to a drive pulse signal generated from a control portion 11 (shown in FIG. 4) of the printer 1, and the flow-passage unit 107 has a multiplicity of ink passages communicating with the respective nozzles 109. The actuator unit 106 and the flow-passage unit 107 are bonded together with a thermosetting adhesive agent such as an epoxy resin. Although the FPC boards 40 are bonded to the upper surface of the actuator unit 106, these FPC boards 40 are not shown in FIG. 3, in the interest of brevity.

The flow-passage unit 107 is a laminar structure consisting of three thin metal plates (a cavity plate 107*a*, a spacer plate 107*b* and a manifold plate 107*c*) formed of a metallic material, and a nozzle plate 107*d* formed of a synthetic resin material such as polyimide. The uppermost cavity plate 107*a* is bonded at its upper surface to the actuator unit 106.

The ink-jet head 6*a* has two parallel rows of pressure chambers 110 formed through the cavity plate 107*a* such that the pressure chambers 110 in each row are arranged and spaced apart from each other by partition walls 110*a*, in the longitudinal direction of the ink-jet head 6*a*. The pressure chambers 110 are filled with the yellow ink, so that droplets of the ink are ejected from the selected ones of the nozzles 109 upon selective operation of the corresponding local active portions of the actuator unit 106. The spacer plate 107*b* has a communication hole 111 for communication of each pressure chamber 110 at one of its opposite ends with the corresponding nozzle 109, and another communication hole (not shown) for communication of each pressure chamber 110 at the other end with a manifold passage (not shown) formed in the manifold plate 107*c*.

The manifold plate 107*c* has a communication hole 113 for communication between the communication hole 111 and the corresponding nozzle 109. Since the pressure chambers 110 are arranged in the two rows, the manifold plates 107*c* has two manifold passages corresponding to these two rows of the pressure chambers 110. Each of the manifold passages is elongated so as to extend in a direction of arrangement of the pressure chambers 110 of the corresponding row, and is located below that row. Each manifold passage is connected at one of its longitudinally opposite ends with the corresponding one of the four ink cartridges 61 through the corresponding one of the four ink supply holes 51 (shown in FIG. 2). Thus, the flow-passage unit 107 has a multiplicity of ink passages each of which extends from the manifold passage to the corresponding nozzle 109 through the above-indicated another communication hole, the pressure chamber 110 and the communication holes 111, 113.

The actuator unit 106 is a laminar structure consisting of six piezoelectric ceramic plates 106*a*–106*f* formed of lead zirconate titanate (PZT). Two common electrodes 121 are formed between the piezoelectric ceramic plates 106*b* and 106*c*, while two common electrodes 123 are formed between the piezoelectric ceramic plates 106*d* and 106*e*, such that the two common electrodes 121 are aligned with respective two areas of the flow-passage unit 107 in which the respective two rows of pressure chambers 110 are formed, and the two common electrodes 123 are aligned with those two areas, respectively. Two rows of multiple individual electrodes 122 are formed between the piezoelectric ceramic plates 106*c* and 106*d* such that the individual electrodes 122 are aligned with the respective pressure chambers 110 of the two rows, while two rows of multiple individual electrodes 124 are formed between the piezoelectric ceramic plates 106*e* and 106*f* such that the individual electrodes 124 are aligned with the respective pressure chambers 110 of the two rows.

The common electrodes 121, 123 are kept at the ground potential, and the individual electrodes 122, 124 are selectively energized according to the drive pulse signals. The portions of the piezoelectric ceramic plates 106*c*–106*e* which are located between the common electrodes 121, 123 and the individual electrodes 122, 124 function as active portions 125 which have been polarized in the direction of lamination of the plates 106*a*–106*f*, with an electric field applied thereto through the electrodes 121–124. When each individual electrode 122, 124 is given a predetermined positive potential, the corresponding active portion 125 is subjected to an electric field and is expanded in the direction of lamination while the corresponding local portion of the piezoelectric ceramic plates 106*a*, 106*b* maintain the original state, so that the active portion 125 is expanded so as to partially protrude into the corresponding pressure chamber 110, whereby the volume of the pressure chamber 110 is reduced, with a result of application of a pressure to the ink in the pressure chamber 110, causing the ink to be ejected from the nozzle 109.

FIG. 3 shows the two adjacent pressure chambers 110 placed in different states, for explaining the operation of the actuator unit 106. The individual electrodes 122, 124 corresponding to the left one of the pressure chamber 110 are given the predetermined positive potential, and the corresponding active portion 125 of the actuator unit 106 is expanded so as to be convex toward the left pressure chamber 110, so that the volume of the left pressure chamber 110 is reduced, whereby the ink is ejected from the nozzle 109 communicating with the left pressure chamber 110. On the other hand, the drive pulse signal to be applied to the individual electrodes 122, 124 corresponding to the right pressure chamber 110 is such that the individual electrodes 122, 124 are held at the ground potential, like the common electrodes 121, 123, so that the ink is not ejected from the nozzle 109 communicating with the right pressure chamber 110.

In the present first embodiment, the ink-jet heads 6*a*–6*d* are operated to perform so-called "fill-before-fire" actions for ejecting droplets of ink. Where the fill-before-fire action is performed by the ink-jet head 6*a*, for example, all of the pressure chambers 110 are normally placed in a reduced-volume state, like the left pressure chamber 110 shown in FIG. 3. Namely, all of the individual electrodes 122, 124 are normally kept at the predetermined positive potential, so that the active portions 125 are all expanded to be convex toward the respective pressure chambers 110. The individual electrodes 122, 124 corresponding to each nozzle 109 from which the ink is required to be ejected are given the ground potential at appropriate timings, so that the volume of the corresponding pressure chamber 110 is increased, like the right pressure chamber 110 shown in FIG. 3. As a result, a negative pressure wave is generated in the pressure chamber 110, and the generated pressure wave propagates through the pressure chamber 110 in its longitudinal direction. When the negative pressure wave is changed into a positive pressure wave, the individual electrodes 122, 124 are again given the predetermined positive potential, so that the corresponding active portion 125 is expanded so as to be convex toward the pressure chamber 110, with a result of pressurizing the ink within the pressure chamber 110. This fill-before-fire action permits a high rate of ejection of the ink droplets with a comparatively low drive voltage.

Referring further to the block diagram of FIG. 4, there will be described a control portion 11 of the color ink-jet printer 1, which is arranged to control the operations of the ink-jet heads 6*a*–6*d*. The control portion 11 includes a print-data memory portion 12 for storing print data received from an external device such as a personal computer. The print data to be stored in the print-data memory portion 12 includes bit map data representative of a gray-scale value (eight-bit data indicative of one of 256 gray-scale values) at each picture element of an image, for each of the four colors (YMCK).

The control portion 11 further includes a pulse-waveform-data memory portion 24, which is provided to store pulse-waveform data indicative of four different waveforms of the drive pulse signal to be applied to the individual electrodes 122, 124 of the actuator unit 106, to eject at least one droplet of ink from the corresponding nozzle 109. The four different waveforms correspond to respective four ink dots of different sizes, namely, a large dot, a medium dot, a small dot and a very small dot, which correspond to respective four different total volume values of 36 pl, 24 pl, 12 pl and 5 pl of at least one ink droplet, as described below in detail.

FIGS. 5A–5D show the four different waveforms of the drive pulse signal corresponding to the respective large, medium, small and very small dots. In these figures, high level (H) and low level (L) respectively correspond to a low voltage and a high voltage applied to the individual electrodes 122, 124. The waveform of the drive pulse signal of FIG. 5A for the large ink dot (36 pl) has four high-level periods H11, H12, H13 and H14 (for placing the pressure chamber 110 in an increased-volume state, like the right pressure chamber 110 shown in FIG. 3), and low-level periods (for placing the pressure chamber 110 in the reduced-volume state, like the left pressure chamber 110 shown in FIG. 3) adjacent to the high-level periods. Upon termination of the first three high-level periods H11, H12 and H13 (each of which is about 4–6 μs), respective three ink droplets (each having a volume of 12 pl) are ejected from the corresponding nozzle 109 by the above-indicated fill-before-fire actions during a feeding movement of the carriage 64, so that one large ink dot (36 pl) is formed by the three ink droplets which overlap each other on the paper sheet 62. The fourth high-level period H14 (which is about 3 μs) is provided not for ejecting an ink droplet, but for offsetting a variation in the ink pressure remaining in the pressure chamber 110 in question, in order to avoid an adverse influence of the present ink ejection on the next ink ejection associated with the same pressure chamber 110.

Figure 5A:
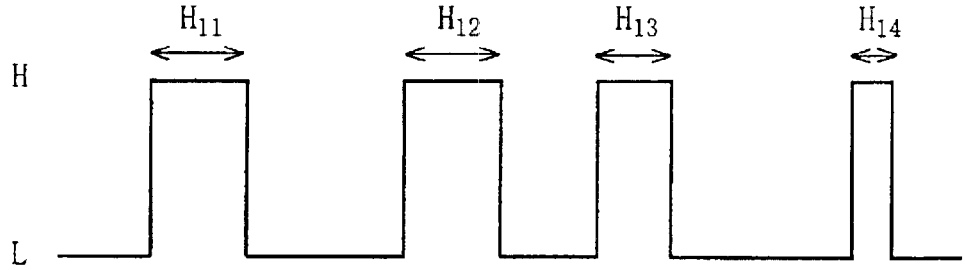
FIGS. 5A–5D are views indicating patterns of drive pulse signals to be applied to the ink-jet head of FIG. 3.
Figure 5B:
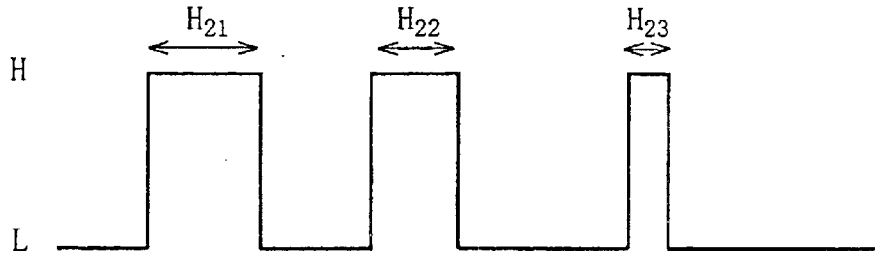

The waveform of the drive pulse signal of FIG. 5B for the medium ink dot (24 pl) has three high-level periods H21, 22 and H23, and the adjacent low-level periods. Upon termination of the first two high-level periods H21 and H22 (each of which is about 4–6 μs), respective two ink droplets (each having a volume of 12 pl) are ejected from the corresponding nozzle 109 by the above-indicated fill-before-fire actions, so that one medium ink dot (24 pl) is formed by the two ink droplets which partially overlap each other on the paper sheet 62. The third high-level period H23 (which is about 3 μs) is provided not for ejecting an ink droplet, but for offsetting a variation in the ink pressure remaining in the pressure chamber 110 in question.

Figure 5C:
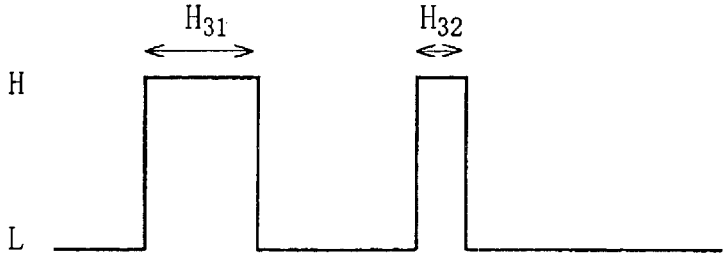

The waveform of the drive pulse signal of FIG. 5C for the small ink dot (12 pl) has two high-level periods H31 and H32, and the adjacent low-level periods. Upon termination of the first one high-level period H31 (which is about 4–6 μs), one ink droplet (having a volume of 12 pl) is ejected from the corresponding nozzle 109 by the above-indicated fill-before-fire action, so that one small ink dot (12 pl) is formed by the one ink droplet on the paper sheet 62. The second high-level period H32 (which is about 3 μs) is provided not for ejecting an ink droplet, but for offsetting a variation in the ink pressure remaining in the pressure chamber 110 in question.

Figure 5D:
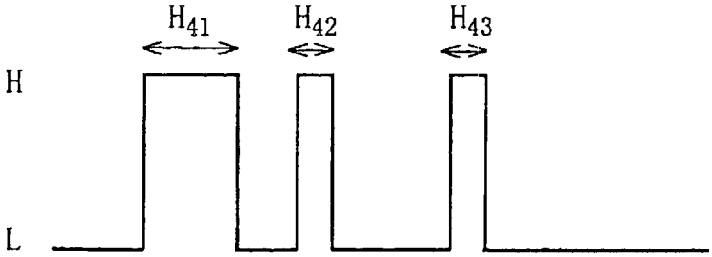

The waveform of the drive pulse signal of FIG. 5D for the very small ink dot (5 pl) has three high-level periods H41, H42 and H43, and the adjacent low-level periods. The first one high-level period H41 (which is about 4–6 μs) for ejecting one ink droplet (having a volume of 12 pl) is followed by the relatively short first low-level period which precedes the second high-level period H42 (which is about 2 μs), so that a trailing end portion of an ink droplet being ejected from the corresponding nozzle 109 is fed back into the nozzle 109 by the drawing action caused by the second short high-level period H42, whereby the ink droplet actually ejected from the nozzle 109 has a volume of about 5 pl. As a result, one very small ink dot (5 pl) is formed on the paper sheet 62. The third high-level period H43 (which is about 3 μs) is provided not for ejecting an ink droplet, but for offsetting a variation in the ink pressure remaining in the pressure chamber 110 in question.

The control portion 11 further includes four ink-volume determining portions 13, 14, 15 and 16 corresponding to the respective four colors Y, M, C and K, that is, a Y-ink-volume determining portion 13, an M-ink-volume determining portion 14, a C-ink-volume determining portion 15 and a K-ink-volume determining portion 16. The Y-ink-volume determining portion 13 is arranged to determine the total volume value of at least one ink droplet to be ejected from each nozzle 109 of the corresponding ink-jet head 6*a* to form each dot of the yellow ink on the paper sheet 62, on the basis of the gray-scale values indicated by the print data stored in the print-data memory portion 12. Namely, on the basis of the gray-scale values at the picture elements, the Y-ink-volume determining portion 13 selects one of the large, medium and small ink dots, or determines that no yellow ink dot is formed at the picture element in question, that is, determines that the total ink volume value is zero. Where the gray-scale value at a given picture element corresponds to the very small yellow ink dot, the Y-ink-volume determining portion 13 selects the small ink dot.

The M-ink-volume determining portion 14 is arranged to determine the total volume value of at least one ink droplet to be ejected from each nozzle 109 of the corresponding ink-jet head 6*b* to form each dot of the magenta ink on the paper sheet 62, on the basis of the gray-scale values stored in the print-data memory portion 12. Namely, on the basis of the gray-scale value at each picture element, the M-ink-volume determining portion 14 selects one of the large, medium, small and very small ink dots, or determines that no magenta ink dot is formed at the picture element in question. The C-ink-volume and K-ink-volume determining portions 15 and 16 are arranged to determine the total volume value of at least one ink droplet to be ejected from each nozzle 109 of the ink-jet head 6*c*, and the total volume value of at least one ink droplet to be ejected from each nozzle 109 of the ink-jet head 6*d*, in the same manner as the M-ink-volume determining portion 14.

TABLE 1 given below indicates the total volume values of at least one droplet which forms each dot of the yellow ink, and the total volume values of at least one droplet which forms each dot of each of the other colors (magenta, cyan and black). Namely, TABLE 1 indicates the yellow ink dot sizes and the sizes of the dots of the other colors, which are available or selectable depending upon the gray-scale value at each picture element of an image at which ink dots are to be formed according to the print data. In the table, "o" indicates that the appropriate dot size (total volume value) is available, while "x" indicates that the appropriate dot size is not available.

TABLE 1

| Total Volume Value | Yellow (Y) Ink | Magenta (M), Cyan (C) and Black (B) Inks |
|---|---|---|
| LARGE | o | o |
| MEDIUM | o | o |
| SMALL | o | o |
| VERY SMALL | x | o |
| NO INK DOT | o | o |

The control portion 11 further includes four pulse generators 17, 18, 19, 20 for the respective colors Y, M, C and K, namely, a Y-pulse generator 17, an M-pulse generator 18, a C-pulse generator 19 and a K-pulse generator 20. The pulse generators 17–20 are arranged to generate drive pulse signals of appropriate waveforms to be applied to the respective ink-jet heads 6*a*–6*d*, on the basis of the total volume values of at least one droplet of ink determined by the respective ink-volume determining portions 13–16, and according to the waveform patterns stored in the pulse-waveform-data memory portion 24, so that the ink dots of the yellow, magenta, cyan and black colors which are ejected from the nozzles 109 of the ink-jet heads 6*a*–6*d* have the sizes corresponding to the determined total volume values. The drive pulse signals generated by the pulse generators 17–20 are applied to the respective ink-jet heads 6*a*–6*d*.

The control portion 11 including the various portions 12–20, 22, 24 is constituted by a central processing unit (CPU), a random-access memory (RAM), a read-only memory (ROM), etc. The ROM serves as the pulse-waveform-data memory portion 24 storing the pulse-waveform data, and stores other software such as control programs and data for various operations to be performed by the control portion 11.

In the present first embodiment, the print-data memory portion 12 cooperates with each of the M-ink-volume, C-ink-volume and K-ink-volume determining portions 14–16 to constitute a first control portion, while the print-data memory portion 12 and the Y-ink-volume determining portion 13 cooperate to constitute a second control portion. The first control portion is operable to control the actuator unit 106 of the ink-jet heads 6*b*, 6*c* and 6*d* on the basis of a gray-scale value at each picture element at which each dot of each of the magenta, cyan and black inks is formed to form an image on the paper sheet 62 such that a total volume of at least one droplet of each of the magenta, cyan and black inks, which is ejected by the corresponding ink-jet head 6*b*, 6*c*, 6*d* to form each ink dot of these colors on the paper sheet 62 is equal to a selected one of a plurality of different total volume values (36 pl, 24 pl, 12 pl, 5 pl and 0 pl), while the second control portion is operable to control the actuator unit 106 of the ink-jet heads 6*a* on the basis of a gray-scale value at each picture element of the image at which each dot of the yellow ink is to be formed on the paper sheet 62 such that a total volume of at least one droplet of the yellow ink ejected by the ink-jet head 6*a* to form each yellow ink dot on the paper sheet 62 is equal to another value of the different total volume values, which another value is other than a smallest one of the different total volume values except a zero value which does not cause ejection of any ink droplet from the ink-jet head 6*a*.

Figure 6:
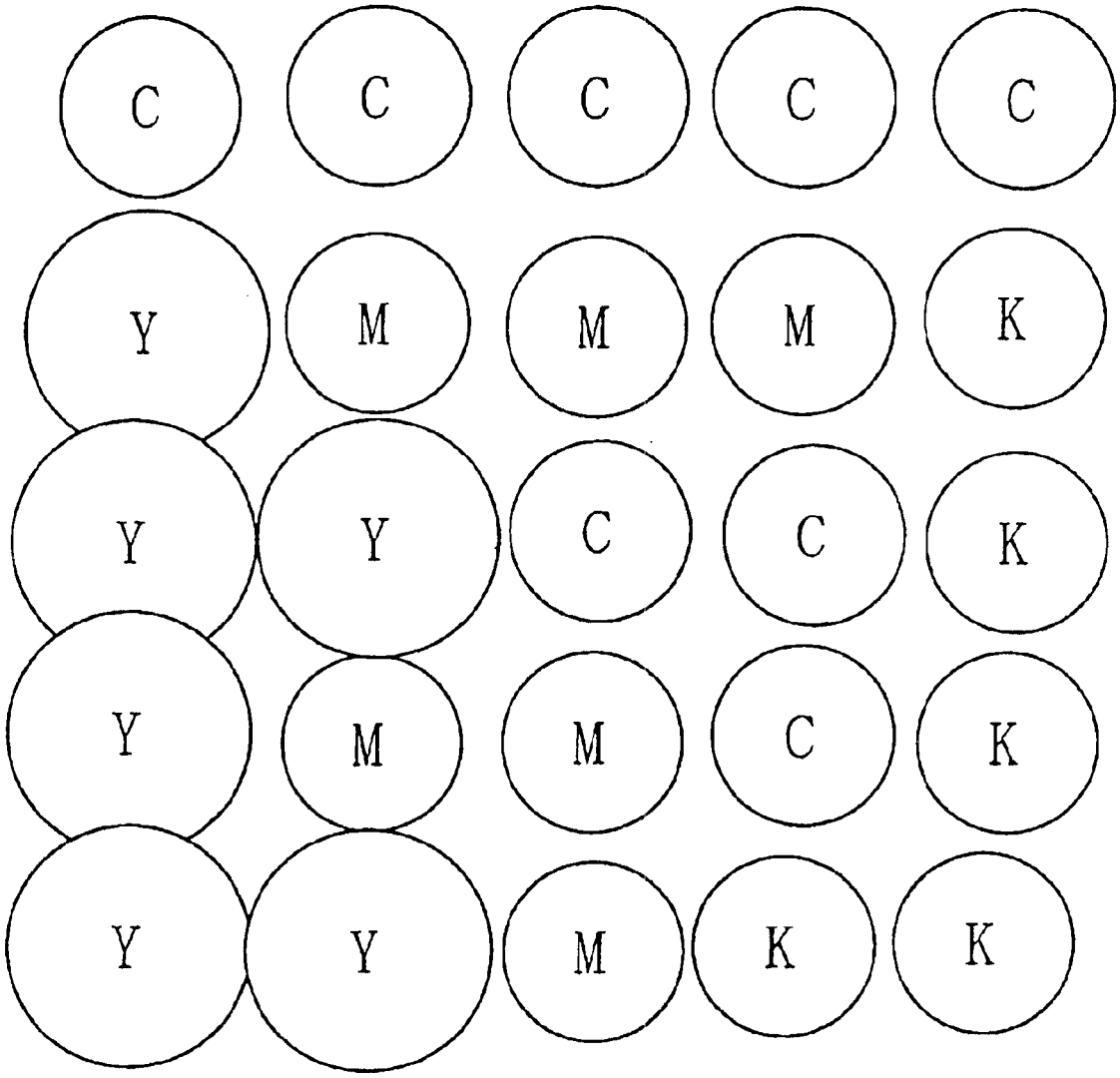
FIG. 6 is a view illustrating an example of a pattern of ink dots of different-color inks formed on a paper sheet by the color ink-jet printer of FIG. 1.

Referring further to FIG. 6, there will be described an example of a printing operation of the present color ink-jet printer 1 to form an image on the paper sheet 62, more specifically, an example of an arrangement of ink dots of yellow, magenta, cyan and black colors which are formed on the paper sheet 62, where the very small total volume value is selected for all of the four colors (Y, M, C and K), to form the very small dots at all of the corresponding picture elements, according to the gray-scale values indicated by the print data. That is, the gray-scale values at all of the picture elements for all of the four colors correspond to the very small total volume value (5 pl).

In the present specific example wherein the gray-scale values at all of the picture elements for all of the four colors Y, M, C and K correspond to the very small total volume value, only one droplet of ink is ejected from each nozzle 109 of each of the ink-jet heads 6*b*–6*d*, to form the very small dot of the magenta, cyan or black ink. However, the ink-jet head 6*a* for the yellow color is inhibited from ejecting only one droplet having the very small volume of 5 pl from its nozzles 109, that is, from forming the very small dot of the yellow ink, in order to prevent plugging of the nozzles due to an increase of the viscosity of the yellow ink at the meniscus surfaces of the yellow ink in the nozzles 109. Instead, the Y-ink-volume determining portion 13 selects the total volume value of 12 pl, that is, the small yellow ink dot size rather than the very small yellow dot size, even where the gray-scale value at the picture elements at which the yellow dots are to be formed according to the print data corresponds to the very small dot size. Although the small yellow ink dot is formed by only one droplet, like the very small yellow ink dot, the volume (12 pl) of the droplet for the small dot is more than two times that (5 pl) of the droplet for the very small dot, so that the droplet for the small dot has a considerably larger kinetic energy than the droplet for the very small dot, and can be ejected through the meniscus surface of the yellow ink at the nozzle 109, even where the viscosity at the meniscus surface is more or less increased during a non-ejection period of the ink-jet head 6*a*. The matrix of the dots shown in FIG. 6 consists of not only the very small dots of the magenta, cyan and black inks, but also the small dots of the yellow inks thus formed on the paper sheet 109. As described above, although the size of the yellow ink dots actually formed on the paper sheet 62 is larger than that according to the gray-scale value of the print data, the comparatively large dots of the yellow ink have substantially no influence on the formed gray-scale image, since the yellow dots in the image are less likely to be perceived than the dots of the other colors.

As described above, the color ink-jet printer 1 of the present embodiment is arranged such that the second ink ejecting portion in the form of the ink-jet head 6*a* is controlled to eject from its nozzles 109 at least one droplet of the yellow ink, which is selected from among the four total volume values (36 pl, 24 pl, 12 pl and 0 pl). That is, the ink-jet head 6*a* is prevented from ejecting only one ink droplet so as to form the very small dot (5 pl), so that the nozzles 109 of this ink-jet head 6*a* for the yellow ink which has the relatively high drying speed are protected against plugging with the dried ink, when the ink is ejected from the nozzles 109 after a relatively long non-ejection period of the ink-jet head 6*a*. Thus, the present color ink-jet printer 1 is capable of forming a gray-scale image by selecting one of the plurality of different total volume values of at least one ink droplet to be ejected from each nozzle 109 to form the corresponding ink dot at the corresponding picture element on the paper sheet 62, while minimizing the deterioration of quality of the printed gray-scale image due to plugging of the nozzles with the dried inks, in particular, plugging of the nozzles of the ink-jet head 6*a* for the yellow ink which is dried at a higher rate that the magenta, cyan and black inks.

Then, a second embodiment of the present invention will be described. This second embodiment is arranged to: measure a non-ink-ejection time of each nozzle 109 of the ink-jet head 6*a*; determine whether the measured non-ink-ejection time has reached a predetermined non-ink-ejection period; inhibit the selection of the very small total volume (formation of the very small dot of the yellow ink) within a predetermined length of time after the moment of initiation of an operation of the ink-jet head 6*a* to eject the yellow ink droplets from the nozzle 109 in question, which operation is initiated after the predetermined non-ink-ejection period; and permits the selection of any one of the five different total volume values on the basis of the gray-scale value at the picture element in question, after expiration of the predetermined length of time.

Figure 4:
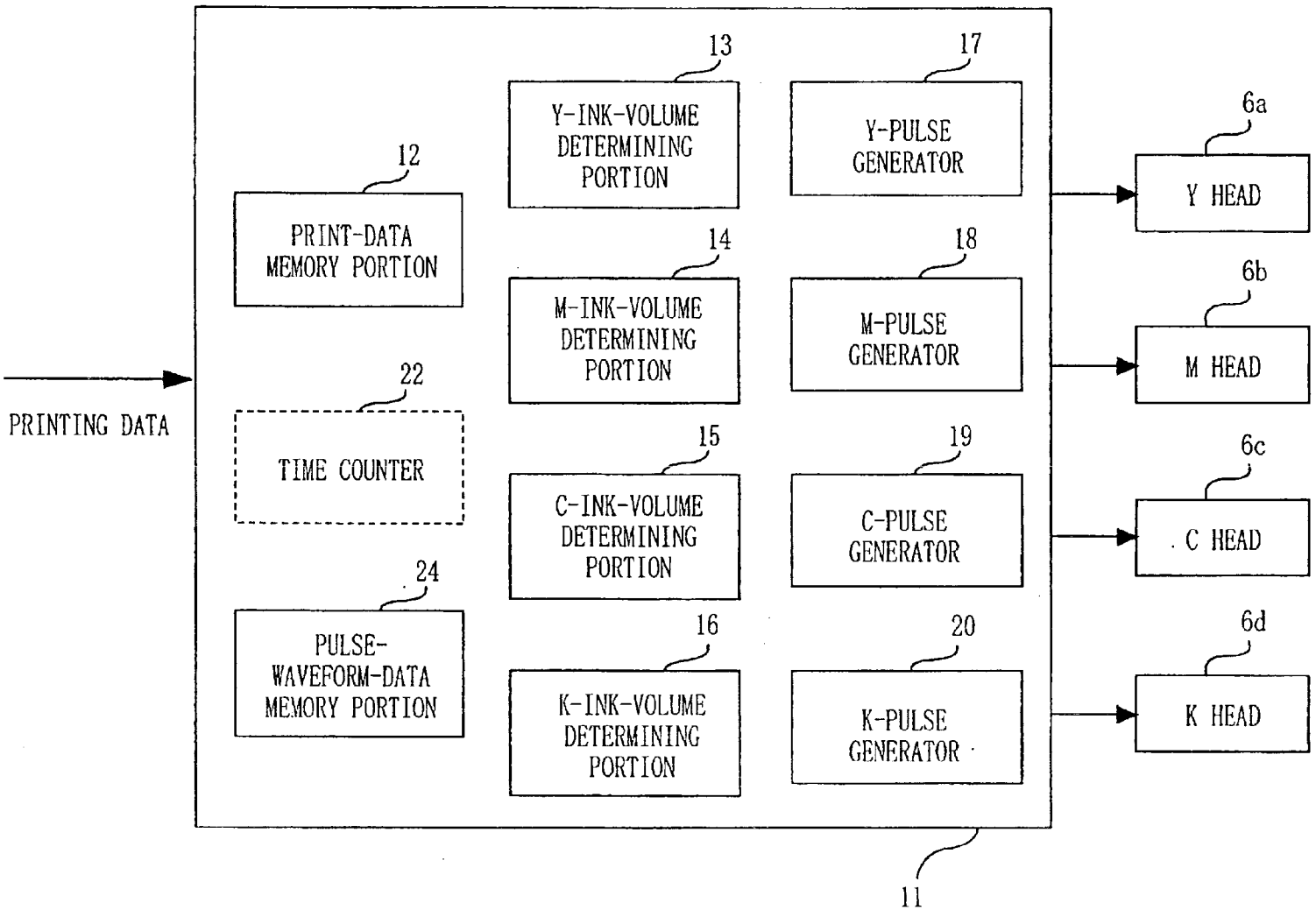
FIG. 4 is a block diagram illustrating a control portion of the color ink-jet printer of FIG. 1.

The control portion 11 of the color ink-jet printer 1 constructed according to the second embodiment includes a time counter 22 indicated by broken-line block in FIG. 4. This time counter 22 is arranged to measure the non-ink-ejection time of each nozzle 109 of the ink-jet head 6*a* during which any droplet of the yellow ink has not been ejected from the nozzle 109 after the moment of the last ejection of the ink droplet(s).

The Y-ink-volume determining portion 13 corresponding to the ink-jet head 6*a* is arranged to determine the total volume value of at least one droplet of the yellow ink corresponding to each nozzle 109, on the basis of the gray-scale value at the picture element at which each yellow ink dot is to be formed according to the print data stored in the print-data memory portion 12, and on the basis of the non-ink-ejection time of each nozzle 109 of the ink-jet head 6*a* measured by the time counter 22. Described more specifically by reference to FIG. 7A, the Y-ink-volume determining portion 13 determines whether the measured non-ink-ejection time of the nozzle 109 in question has exceeded a predetermined non-ink-ejection period T1, and checks if an operation of the nozzle 109 of the ink-head 6*a* is initiated after the predetermined non-ink-ejection period T1. If the initiation of this operation is detected, the determining portion 13 further measures a time of the operation of the nozzle 109 to eject the yellow ink, and determines whether this time has reached a predetermined length of time T2. During this predetermined length of time T2, the determining portion 13 selects one of the four total volume values (36 pl for the large ink dot, 24 pl for the medium ink dot, 12 pl for the small dot, and 0 pl for non-ejection of any ink droplet), on the basis of the gray-scale value at each picture element. For example, the determining portion 13 selects the small total volume value for the small dot of the yellow ink even when the very small total volume value is to be selected according to the gray-scale value. After expiration of the predetermined length of time T2, the determining portion 13 selects one of the five total volume values (36 pl, 24 pl, 12 pl, 5 pl and 0 pl) on the basis of the gray-scale value at the picture element corresponding to the nozzle 109 in question.

TABLE 1 given above indicates the total volume values of at least one droplet of the yellow ink, and those of at least one droplet of each of the magenta, cyan and black inks, which are available within the predetermined length of time T2 after the moment of initiation of an ink ejection operation of the nozzle 109, which is initiated more than the predetermined non-ink-ejection period T1 after the previous ink ejection operation. On the other hand, TABLE 2 given below indicates the total volume values of the yellow ink and those of the inks of the other colors, after the expiration of the predetermined length of time T2. It will be understood from TABLE 1 and TABLE 2 that the selection of the total volume value of 5 pl for the very small ink dot is inhibited for the yellow ink, within the predetermined length of time T2 after the moment of initiation of a yellow-ink ejection operation after the predetermined non-ink-ejection period T1 after the previous yellow-ink ejection operation.

TABLE 2

| Total Volume Value | Yellow (Y) Ink | Magenta (M), Cyan (C) and Black (B) Inks |
|---|---|---|
| LARGE | ○ | ○ |
| MEDIUM | ○ | ○ |
| SMALL | ○ | ○ |
| VERY SMALL | ○ | ○ |
| NO INK DOT | ○ | ○ |

Figure 7A:
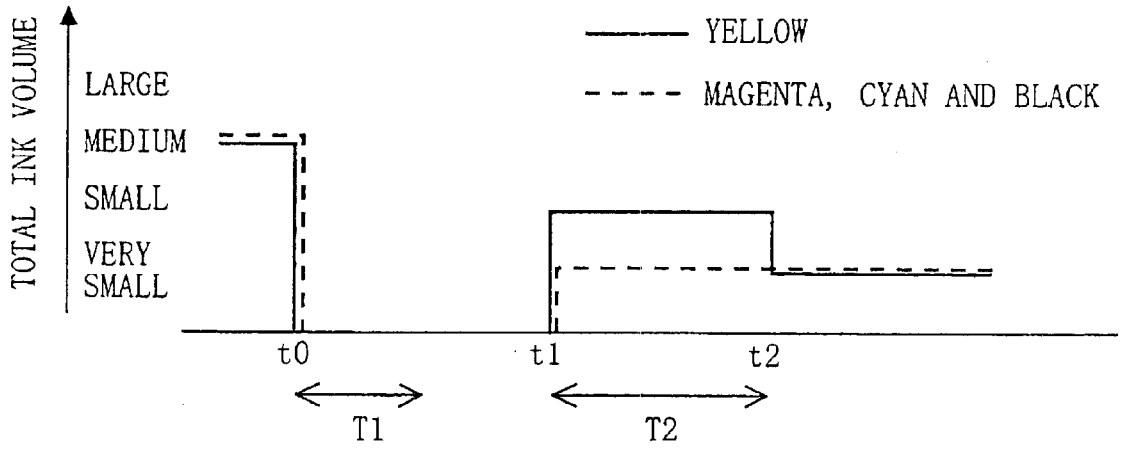
FIG. 7A is a time chart illustrating an example of changes of total volumes of droplets of yellow, black, magenta and cyan inks, which are ejected in the color ink-jet printer of FIG. 1, to form ink dots of the different colors.
Figure 7B:
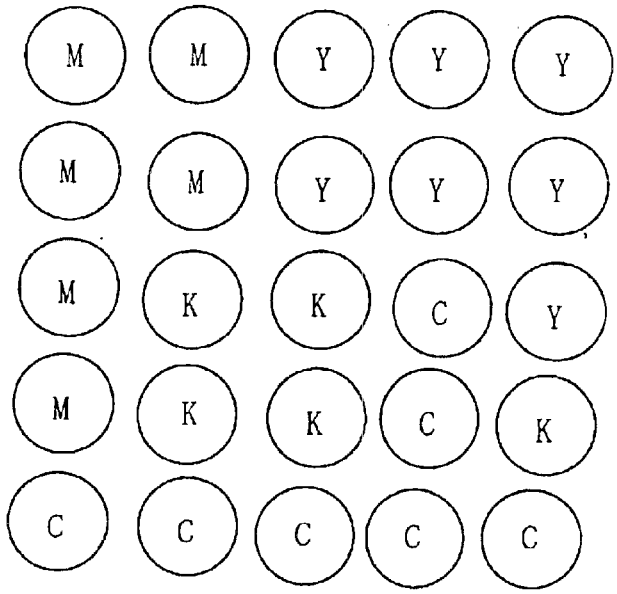
FIG. 7B is a view illustrating an example of a pattern of ink dots of the different colors formed on the paper sheet in the printer of FIG. 1.
Figure 8:
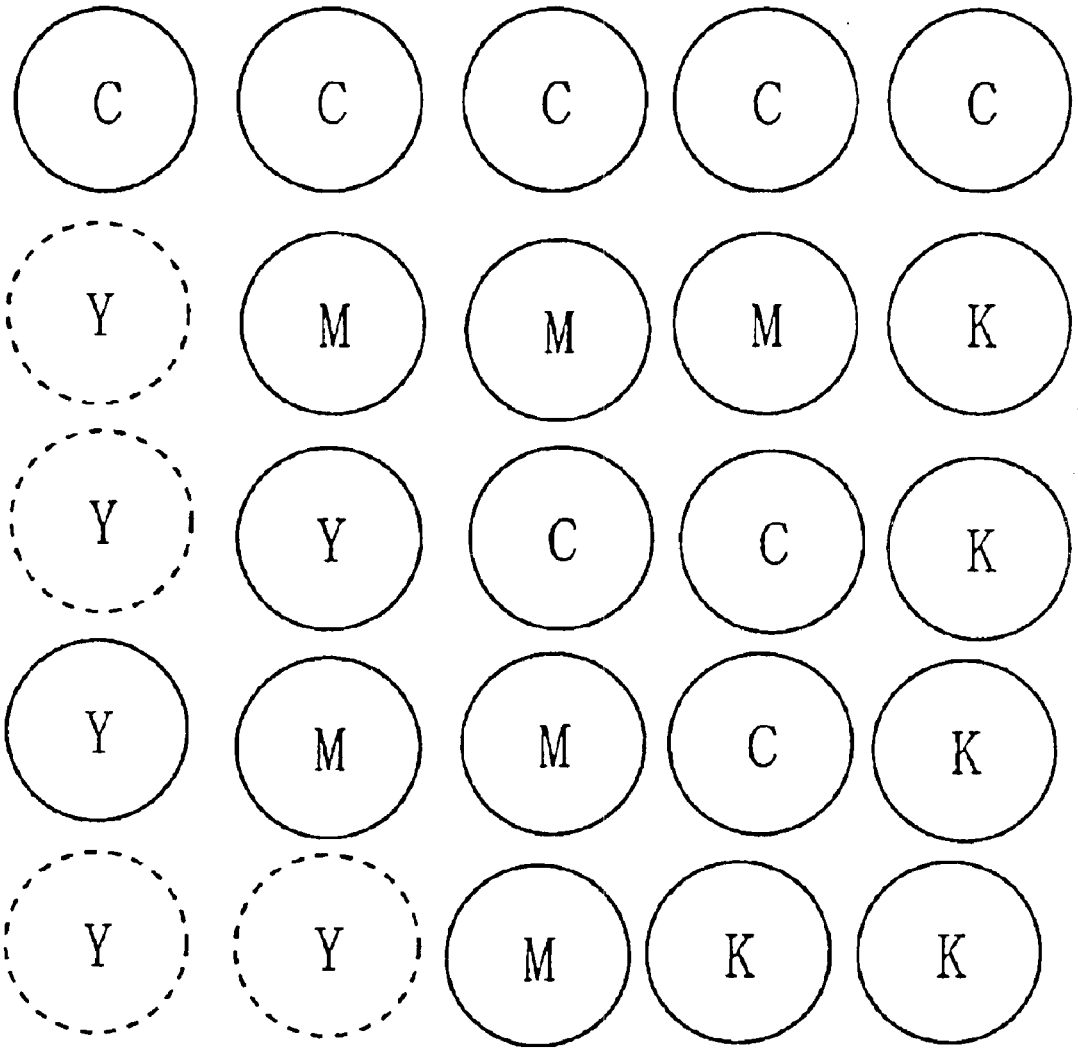
FIG. 8 is a view illustrating an example of an arrangement of ink dots of the different-color inks formed on the paper sheet in the conventional color ink-jet printer.

FIG. 7A illustrates an example of changes of the total volume value of at least one droplet of the yellow ink, and the total volume value of the black, magenta and cyan inks, which are ejected from the nozzles 109 of the ink-jet heads 6*a*–6*d* in the second embodiment of this invention. In FIG. 7A, solid lines indicate the change of the total volume value of the yellow ink, while broken lines indicate the change of the total volume values of the magenta, cyan and black inks, where the very small total volume value (for the very small ink dot) is to be selected according to the gray-scale value for all of the different colors Y, M, C and K. FIG. 7B illustrates an example of a pattern of ink dots of the different colors formed on the paper sheet 62 after expiration of the predetermined length of Time T2 indicated in FIG. 7A.

In the specific example of FIG. 7A, the ink droplets of the medium total volume are ejected from the nozzles 109 in question, to form the medium-size dots of the yellow, magenta, cyan and black inks, in an ink ejection operation of each nozzle 109 up to a point of time t0. This ink ejection operation is followed by a non-ink-ejection time between the point of time t0 and a point of time t1. This non-ink-ejection time is longer than the predetermined non-ink-ejection period T1. The non-ink-ejection time t0–t1 is followed by a subsequent ink ejection operation of each nozzle 109 in which the very small total volume value for the very small ink dot size is to be selected according to the gray-scale values at the picture elements in question for all of the four colors (Y, M, C and K). Within the predetermined length of time T2 after the moment t1 of initiation of the subsequent ink ejection operation, the very small total volume value is selected for each of the magenta, cyan and black inks, to form the very small dots of those colors, while the selection of the very small total volume is inhibited for the yellow, to prevent plugging of the nozzles 109 of the ink-jet head 6*a* with the yellow ink whose viscosity has been increased at the meniscus surface during the non-ink-ejection time not shorter than the predetermined time T1. For the yellow ink, the small total volume value is selected to form the small yellow ink dot at each picture element corresponding to the yellow ink, as shown in FIG. 6.

After the expiration of the predetermined length of time T2 after the moment t1 of initiation of the above-indicated subsequent ink ejection operation indicated in FIG. 7A, the viscosity of the yellow ink is lowered to a value close to the normal value during the subsequent ink-ejection operation, and the ink-jet head 6*a* is not likely to suffer from plugging of its nozzles 109 with the dried yellow ink, so that the very small total volume is selected for the yellow ink as well, to form the very small dots of the yellow ink according to the gray-scale value, as indicated in FIG. 7B.

As described above, the ink-jet printer 1 according to the second embodiment is arranged such that one of the four total volume values other than the smallest value (5 pl) except the zero value (0 pl), that is, one of the four total volume values (36 pl, 24 pl, 12 pl and 0 pl) which do not include the very small value (5 pl) is selected as the total volume value of at least one droplet of the yellow ink ejected by each nozzle 109 of the ink-jet head 6*a*, on the basis of the gray-scale value at the corresponding picture element at which each dot of the yellow ink is to be formed on the paper sheet 62. This arrangement prevents plugging of the nozzles 109 of the ink-jet head 6*a* with the yellow ink due to increased viscosity of the ink at the meniscus surface after a relatively long non-ink-ejection time of the nozzles 109. Accordingly, the color ink-jet printer 1 of this second embodiment is also capable of forming a gray-scale image by selecting one of the plurality of different total volume values of at least one ink droplet to be ejected from each nozzle 109 to form the corresponding ink dot at the corresponding picture element on the paper sheet 62, while minimizing the deterioration of quality of the printed gray-scale image due to plugging of the nozzles with the dried inks, in particular, plugging of the nozzles of the ink-jet head 6*a* for the yellow ink which is dried at a higher rate that the magenta, cyan and black inks.

In addition, the second embodiment is arranged to permit the selection of one of the five total volume values including the very small value corresponding to the very small dot, for the yellow ink as well as the inks of the other colors, on the basis of the gray-scale values at the corresponding picture elements, after the expiration of the predetermined length of time T2 after the moment time t1 of initiation of the subsequent ink ejection operation, so that the gray-scale image can be formed with improved quality, owing to the gradation in the five steps rather than the four steps.

In the first and second embodiments described above, the pulse generators 17–20 are arranged to generate the drive pulse signals to be applied to the ink-jet heads 6*a*–6*d* such that the number of at least one ink droplet (each having the volume of 12 pl) to be ejected from the nozzle 109 to form each dot on the paper sheet 62 is changed depending upon the gray-scale value at each picture element, to select one of three sizes of each ink dot, namely, to select one of the large dot (36 pl), medium dot (24 pl) and small dot (12 pl), while the volume of each ink droplet is kept constant. In a third embodiment of this invention, however, the size of each ink dot is changed by changing the volume of each of at least one ink droplet to be ejected from the nozzle 109 to form each dot, by controlling a drive voltage to be applied to the individual electrodes 122, 124, or the waveform of a drive pulse signal to apply the drive voltage.

While the color ink-jet printer 1 according to the illustrated embodiments described above includes the four ink-jet heads 6*a*–6*d* corresponding to the four different colors (Y, M, C and K), the principle of the present invention is equally applicable a color ink-jet printer which includes two, three, five or more ink-jet heads which correspond to respective different colors. Further, the printer may be arranged to inhibit two or more ink-jet heads corresponding to respective different colors from ejecting very small ink dots of those colors, within the predetermined length of time T2 after the moment t1 of initiation of the subsequent ink ejection operation of those two or more ink-jet heads. In this case, the length of time T2 may be changed depending upon the colors of the inks. In the illustrated embodiments, the yellow ink (Y) has a composition which is dried at a higher rate than the other inks (M, C, B). However, the magenta (M), cyan (C) or black (K) ink may have a composition which is dried at a higher rate than the other inks.

While the second embodiment is arranged such that the time counter 22 measures the non-ink-ejection period T1 and the predetermined length of time T2, these period T1 and time T2 may be measured by counting the number of the picture elements in the direction of movement of the ink-jet heads 6*a*–6*d* according to the print data stored in the print-data memory portion 12.

What is claimed is:

1. A color ink-jet printer comprising:

a first ink ejecting portion operable to eject droplets of a first ink of a first color;

a second ink ejecting portion operable to eject droplets of a second ink of a second color other than said first color, said second ink being dried at a higher rate than said first ink;

a first control portion operable to control said first ink ejecting portion, on the basis of a gray-scale value at a picture element of an image at which each dot of said first ink is to be formed on a recording medium, such that a total volume of at least one droplet of said first ink ejected by said first ink ejecting portion to form said each dot of the first ink on the recording medium is equal to any one of a plurality of different total volume values; and a second control portion operable to control said second ink ejecting portion, on the basis of a gray-scale value at a picture element of the image at which each dot of said second ink is to be formed on the recording medium, such that a total volume of at least one droplet of said second ink ejected by said second ink ejecting portion to form said each dot of said second ink on the recording medium, is equal to one of said plurality of different total volume values, which one is other than a smallest one of said different total volume values except a zero value which does not cause ejection of any ink droplet from said second ink ejecting portion.

2. The color ink-jet printer according to claim 1, further comprising first and second pulse generators operable to generate drive pulse signals to be applied to said first and second ink ejecting portions, respectively, such that the total volume of said at least one droplet forming each dot of the first ink and the total volume of said at least one droplet forming each dot of said second ink are variable with a change in the number of said at least one droplet to be ejected from each of said first and second ink ejecting portions to form each ink dot on the recording medium.

3. The color ink-jet printer according to claim 2, wherein the total volume of said at least one droplet forming each dot of the first ink and the total volume of said at least one droplet forming each dot of the second ink are variable while the volume of each of said at least one droplet is kept constant.

4. The color ink-jet printer according to claim 1, further comprising first and second pulse generators operable to generate drive pulse signals to be applied to said first and second ink ejecting portions such that the total volume of said at least one droplet forming each dot of said first ink and the total volume of said at least one droplet forming each dot of said second ink are changed by changing the volume of at least one of said at least one ink droplet to be ejected from each of said first and second ink ejecting portions.

5. The color ink-jet printer according to claim 4, wherein said first and second pulse generators are operable to generate said drive pulse signals such that each dot of each of said first and second inks is provided by only one ink droplet, and such that the volume of said one ink droplet is changed to change a size of said each dot on the basis of the gray-scale value at the corresponding picture element of the image.

6. The color ink-jet printer according to claim 1, wherein said second control portion is operable to select said one of said plurality of different total volume values, within a predetermined length of time after a moment of initiation of an operation of said second ink ejecting portion to eject said at least one droplet of said second ink, which operation is initiated after expiration of a predetermined non-ink-ejection period during which said second ink ejecting portion is kept in a non-operated state, said second control portion selecting any one of said plurality of different total volume values on the basis of the gray-scale value at the picture element corresponding to said each dot of said second ink, after expiration of said predetermined length of time.

7. The color ink-jet printer according to claim 1, further comprising a pulse generator operable to generate drive pulse signals to be applied to said second ink ejecting portion such that said plurality of different total volume values comprise at least three different total volume values including said zero value, said smallest value, and at least one value larger than said smallest value, and wherein when said gray-scale value at said picture element corresponds to said smallest value, said second control portion selects one of said at least one value larger than said smallest value.

8. The color ink-dot printer according to claim 7, wherein said smallest value corresponds to a very small dot of said second ink, and said at least one value larger than said smallest value includes at least two values including two values which respectively correspond to a small dot of said second ink and a dot of said second ink larger than said small dot, and wherein said one of said at least one value larger than said smallest value is one of said two values which corresponds to said small dot.

9. The color ink-jet printer according to claim 1, wherein said first and second colors are selected from among, black, yellow, magenta and cyan.

10. The color ink-jet printer according to claim 1, further comprising a pulse-waveform-data memory for storing pulse-waveform data indicative of a plurality of different waveforms of drive pulse signals to be applied to said first and second ink ejecting portions, said plurality of different waveforms corresponding to said plurality of different total volume values, respectively, and wherein said first control portion is operable to select one of said plurality of different waveforms that corresponds to said any one of said plurality of different total volume values, and said second control portion is operable to select one of said plurality of different waveforms that corresponds to said one of said plurality of different total volume values.

11. A color ink-jet printer comprising:

a first ink ejecting portion operable to eject droplets of a first ink of a first color;

a second ink ejecting portion operable to eject droplets of a second ink of a second color other than said first color, said second ink being dried at a higher rate than said first ink;

a pulse-waveform-data memory for storing pulse-waveform data indicative of a plurality of different waveforms corresponding to respective different total volume values of at least one droplet of each of said first ink and said second ink;

a first control portion operable to select any one of said plurality of different waveforms stored in said pulse-waveform-data memory, on the basis of a gray-scale value at a picture element of an image at which each dot of said first ink is to be formed on a recording medium, and control said first ink ejecting portion to eject said at least one droplet of said first ink, on the basis of the selected any one of said plurality of different waveforms; and a second control portion operable to select, on the basis of a gray-scale value at a picture element of the image at which each dot of said second ink is to be formed on the recording medium, one of said plurality of different waveforms which corresponds to one of said plurality of different total volume values, said one of said plurality of different total volume values being other than a smallest one of said different total volume values except a zero value which does not cause ejection of any ink droplet from said second ink ejecting portion, and control said second ink ejecting portion to eject said at least one droplet of said second ink, on the basis of the selected one of said plurality of different waveforms.

12. The color ink-jet printer according to claim 11, further comprising a first pulse generator operable to generate a drive pulse signal to be applied to said first ink ejecting portion, on the basis of said any one of said plurality of different waveforms selected by said first control portion, and a second pulse generator operable to generate a drive pulse signal to be applied to said second ink ejecting portion, on the basis of said one of said plurality of different waveforms selected by said second control portion.

13. The color ink-jet printer according to claim 11, wherein said plurality of different waveforms stored in said pulse-waveform-data memory correspond to the respective different total volume values which comprise at least two different total volume values including said smallest value and at least one value larger than said smallest value, said second control portion being operable to select one of said at least one value larger than said smallest value when said gray-scale value at said picture element corresponds to said smallest value.

14. The color ink-jet printer according to claim 11, further comprising a time counter operable to measure a non-ink-ejection time during which said second ink ejecting portion is kept in a non-operated state, and wherein said second control portion selects said one of said plurality of different waveforms on the basis of the gray-scale value at the picture element corresponding to said each dot of said second ink when an operation of said second ink ejecting portion is initiated after said non-ink-ejection time measured by said time counter has become longer than a predetermined non-ink-ejection period, said time counter being further operable to measure a predetermined length of time after a moment of initiation of said operation of said second ink ejecting portion to eject said at least one droplet of said second ink, said second control portion selecting any one of said plurality of different waveforms on the basis of the gray-scale value at the picture element corresponding to said each dot of said second ink after said predetermined length of time has been measured by said time counter.

* * * * *